US009759388B2

(12) United States Patent
Berends

(10) Patent No.: US 9,759,388 B2
(45) Date of Patent: Sep. 12, 2017

(54) LED LIGHT BULB ASSEMBLY

(71) Applicant: Boyd Edward Berends, Zeeland, MI (US)

(72) Inventor: Boyd Edward Berends, Zeeland, MI (US)

(73) Assignee: Ningbo QTOP Import & Export Co., Ltd. (CN)

( * ) Notice: Subject to any disclaimer, the term of this patent is extended or adjusted under 35 U.S.C. 154(b) by 204 days.

(21) Appl. No.: 14/535,627

(22) Filed: Nov. 7, 2014

(65) Prior Publication Data

US 2015/0131284 A1 May 14, 2015

Related U.S. Application Data

(60) Provisional application No. 61/902,319, filed on Nov. 11, 2013.

(51) Int. Cl.

| | |
|---|---|
| ***F21S 4/00*** | (2016.01) |
| ***F21K 99/00*** | (2016.01) |
| ***F21K 9/232*** | (2016.01) |
| *F21Y 115/10* | (2016.01) |
| *F21Y 107/30* | (2016.01) |

(52) U.S. Cl.

CPC ..... *F21K 9/135* (2013.01); *F21K 9/232* (2016.08); *F21Y 2107/30* (2016.08); *F21Y 2115/10* (2016.08)

(58) Field of Classification Search

CPC ... F21K 9/232; F21Y 2107/30; F21Y 2115/10
USPC ..... 362/249.02, 800
See application file for complete search history.

(56) References Cited

U.S. PATENT DOCUMENTS

| | | | | |
|---|---|---|---|---|
| 6,580,228 | B1 * | 6/2003 | Chen | F21K 9/90 257/E25.02 |
| 2007/0041200 | A1 * | 2/2007 | Walton | H01J 5/54 362/341 |

* cited by examiner

*Primary Examiner* — Elmito Breval
*Assistant Examiner* — Naomi M Wolford
(74) *Attorney, Agent, or Firm* — The Watson I.P. Group, PLC; Jovan N. Jovanovic; Vladan M. Vasiljevic

(57) ABSTRACT

A light bulb assembly comprising a base, a helical body portion, a LED assembly and an electrical drive. The base includes a cap electrically connectable to a power source. The helical body portion has an outer cylindrical upstanding portion. The helical body portion extends from the base upwardly and has a helical groove disposed along an outer surface. The LED assembly has a strip including a plurality of LED elements that are in a spaced apart orientation. The strip is positionable in the helical groove of the helical body portion. The electrical drive is configured to supply power from the power source to the LED elements. The electrical drive is positioned within the cavity created by at least one of the base and the helical body portion.

6 Claims, 4 Drawing Sheets

LED LIGHT BULB ASSEMBLY

CROSS-REFERENCE TO RELATED APPLICATION

This application claim priority from U.S. Provisional Application Ser. No. 61/902,319 entitled LED Light Bulb Assembly filed Nov. 11, 2013, the entire specification of which is hereby incorporated by reference.

BACKGROUND OF THE DISCLOSURE

1. Field of the Disclosure

The invention relates in general to lighting sources, and more particularly, to an LED light bulb assembly that is configured as a replacement for standard incandescent and compact fluorescent (cfl) bulbs. It will be understood that the same may be applied to generally non-standard bulbs as well.

2. Background Art

It is well known in the art that the standard incandescent bulb, developed over a century ago, is an inefficient source of light; a substantial amount of energy is expended as heat. In recent decades, other sources of light have been developed, including, for example cfl's and the like. More recently, LED's have come of age and are heralded for their energy efficiency. Indeed, at each intensity level, LED elements are more efficient than their predecessor cfl and incandescent bulbs. Additionally, the life cycle of an LED based bulb is approximately three to five times that of a cfl and up to thirty to fifty times longer than an incandescent bulb.

However, problematically, LED elements generally have very uni-directional emission of light. It is often difficult to replicate the light pattern and intensity emitted by a cfl or an incandescent bulb by an LED based bulb. Thus, adoption of these types of bulbs has been slowed by the lack of proper performance in existing devices. Often a performance loss is noticed as the light is not as uniform, not spread in the same manner, and/or otherwise less than optimal.

It is therefore an objective to provide an LED based light bulb assembly that can be provided as a drop in replacement for existing applications wherein a cfl or an incandescent bulb has been heretofore utilized.

SUMMARY OF THE INVENTION

The disclosure is directed to a light bulb assembly comprising a base, a helical body and a LED assembly. The base includes a cap electrically connectable to a power source. The helical body portion has an outer cylindrical upstanding portion. The helical body portion extends from the base, with a helical groove disposed along an outer surface the helical body portion. The LED assembly has a strip including a plurality of LED elements that are in a spaced apart orientation. The strip is positionable in the helical groove of the helical body portion. An electrical drive configured to supply power from the power source to the LED elements. The electrical drive being positioned within the cavity created by at least one of the base and the helical body portion.

BRIEF DESCRIPTION OF THE DRAWINGS

The disclosure will now be described with reference to the drawings wherein.

DETAILED DESCRIPTION OF THE DISCLOSURE

Figure 7:
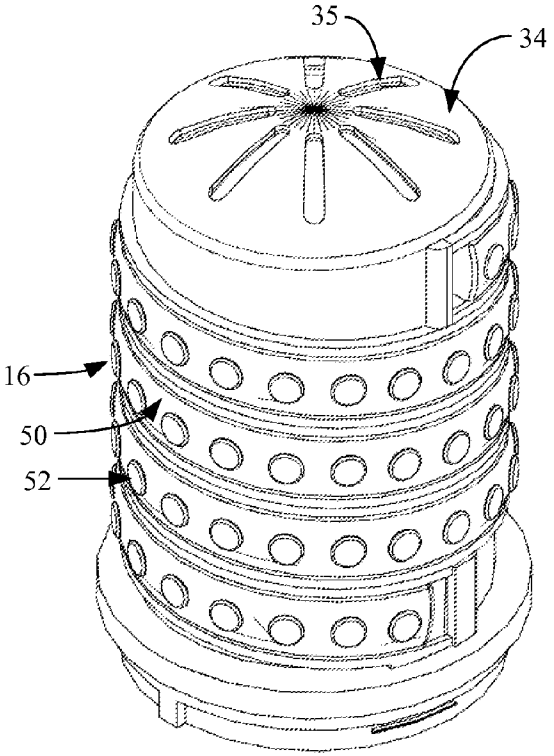
FIG. 7 of the drawings is a partial perspective view of an embodiment of the LED light bulb assembly of the present disclosure, showing, in particular, the arrangement of the LED elements.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 1:
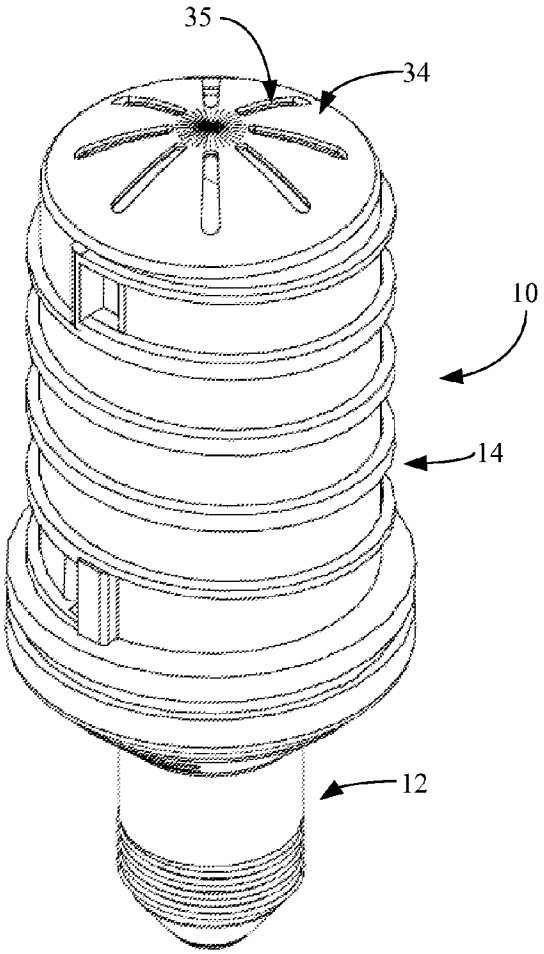
FIG. 1 of the drawings is a perspective view of an embodiment of the LED light bulb assembly of the present disclosure, with the LED light strip removed for clairty.
Figure 8:
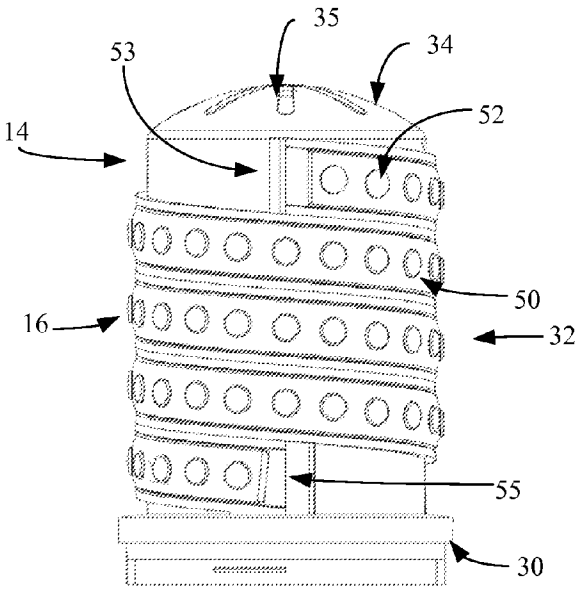
FIG. 8 of the drawings is a front elevational view of the embodiment shown in FIG. 7.

Referring now to the drawings and in particular to FIGS. 1 and 8, collectively, the LED light bulb assembly is shown generally at 10. The assembly is configured for use in association with a conventional screw base, in this case, a standard E26 base, and as such configured as a direct replacement for an incandescent or CFL bulb in any number of different light fixtures. It will be understood that the configuration may be altered to fit any number of different bases, such as smaller bases (i.e., candelabra, etc.) or larger (i.e., mogul, etc.) bases. In addition other types of bases are also contemplated for use.

Figure 2:
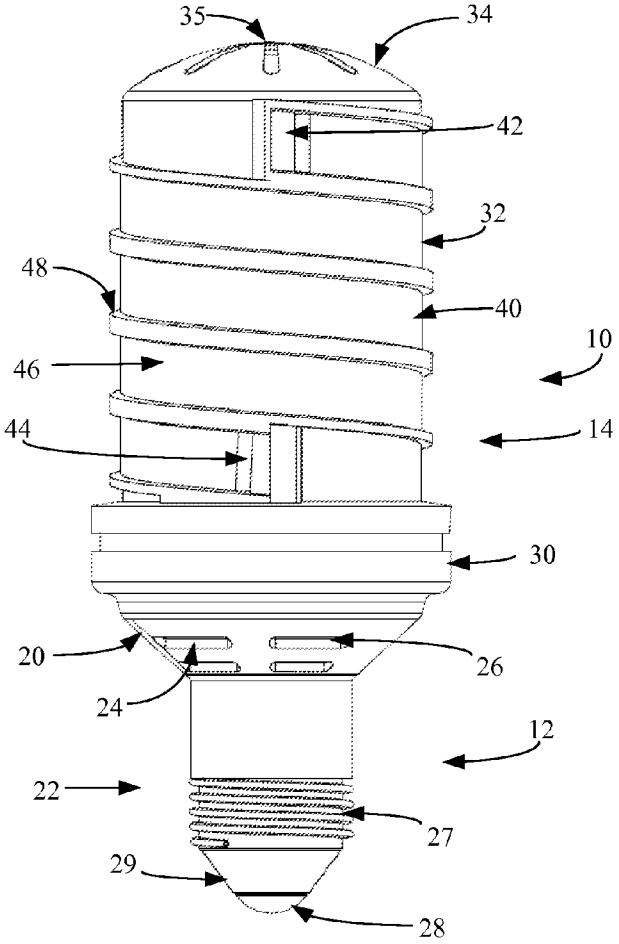
FIG. 2 of the drawings is a front elevational view of the assembly of the present disclosure shown in FIG. 1.
Figure 6:
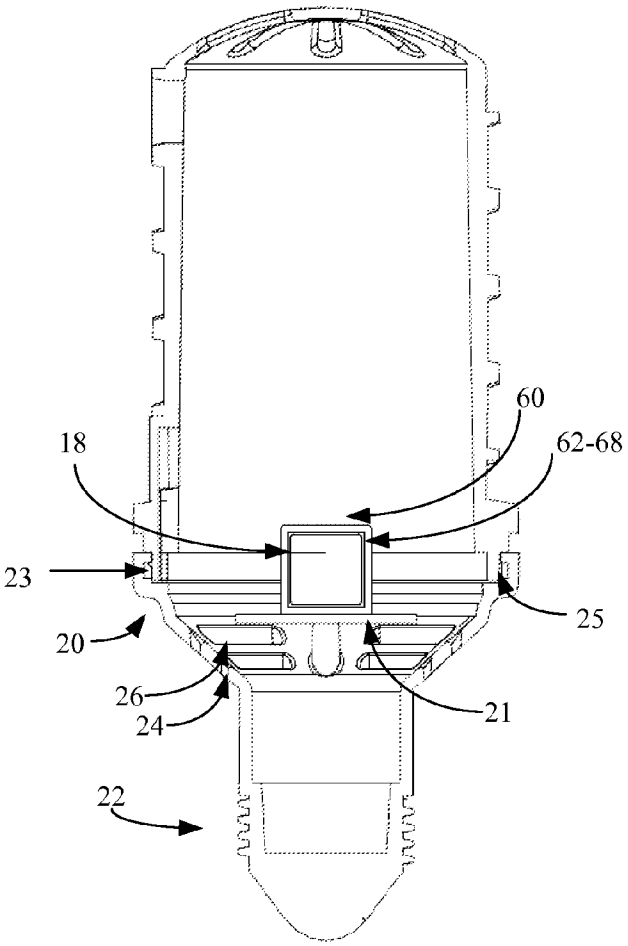
FIG. 6 of the drawings is a cross-sectional view of the assembly of the present disclosure shown in FIG. 1.
Figure 5:
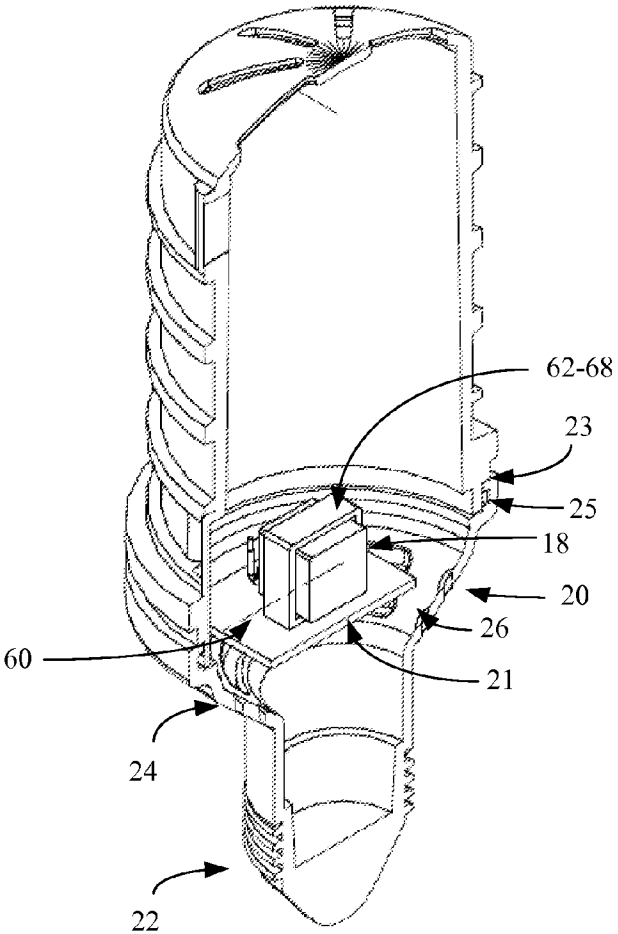
FIG. 5 of the drawings is a cross-sectional view of the assembly of the present disclosure shown in FIG. 1.

With continued reference to FIGS. 1, 5 and 7, the assembly 10 includes base 12, helical body portion 14, LED assembly 16 and electrical driver 18. As is shown in FIGS. 2, 5 and 6, the base 12 includes upper body 20 and lower cap base 22. The upper body 20 includes upper mating structure 23, lower radiating portion 24 and electrical driver mount 21. The upper mating structure 23 is configured to mate with the helical body portion 14, and may include an upper rim structure 25 which interfaces with the helical body portion. The lower radiating portion 24 includes heat dissipating openings 26 which are disposed at predetermined portions on the surface thereof. The lower radiating portion generally comprises a frusto-conical configuration that spans between the configuration of the lower cap base and the helical body portion. In the embodiment shown, the helical body portion is substantially of a radius that is larger than the lower cap base. The lower radiating portion is configured to, in the embodiment shown, maintain the concentricity of the lower cap base and the helical body portion. The electrical drive mount 21 comprises a shelf that is contained within the confines of the lower cap base and the upper body of the base 12.

The lower cap base 22 includes screw thread contact 27, electrical foot contact 28 and insulation 29 therebetween. In the embodiment shown, the lower cap base 22 comprises a conventional E26 standard threaded base. Of course, as disclosed above, other configurations are likewise contemplated for use, and the disclosure is not limited to this particular configuration nor style of configuration.

Figure 4:
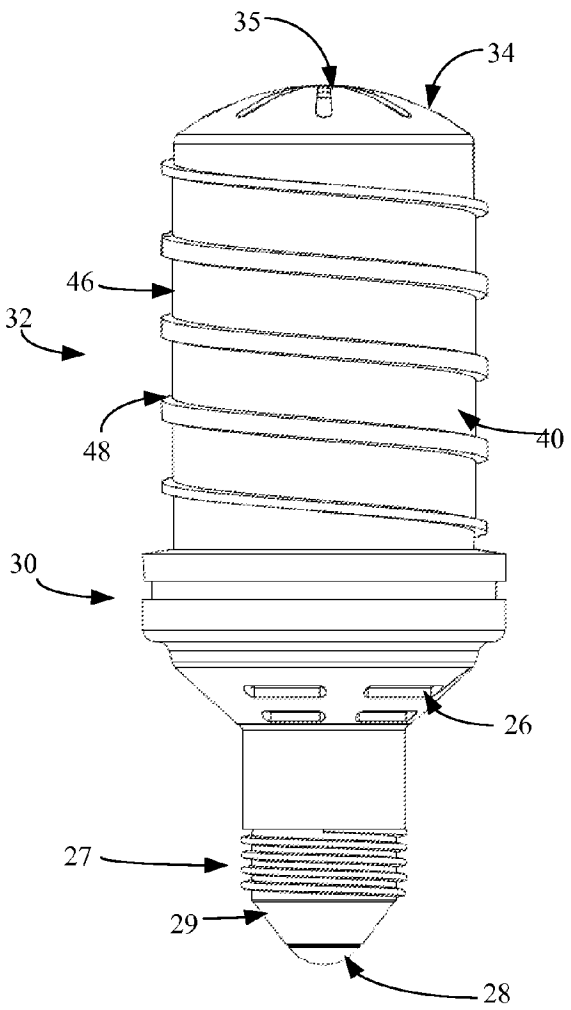
FIG. 4 of the drawings is a back elevational view of the assembly of the present disclosure shown in FIG. 1.
Figure 3:
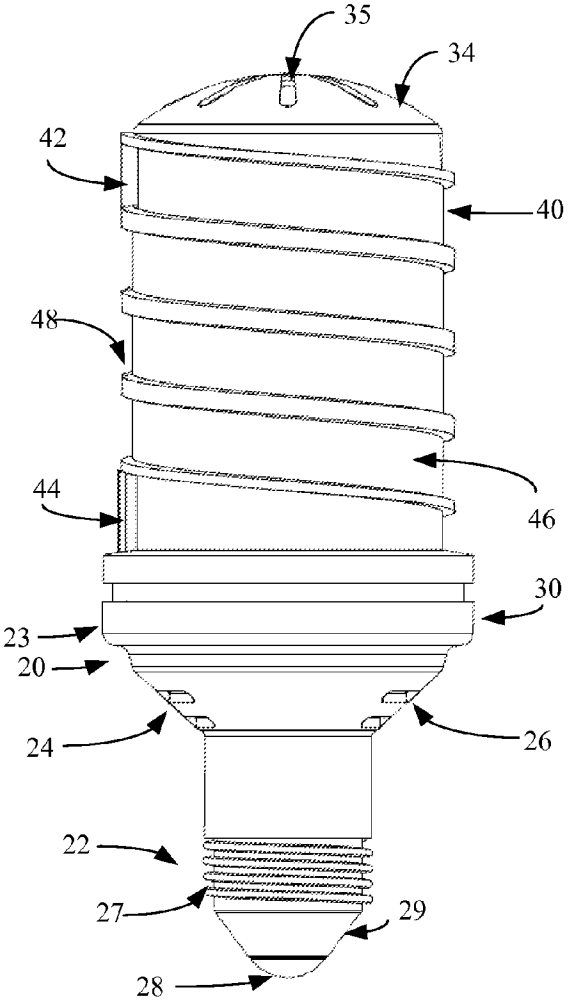
FIG. 3 of the drawings is a side elevational view of the assembly of the present disclosure shown in FIG. 1.

The helical body portion 14 is shown in FIGS. 2, 3 and 4 as comprising lower annular flange 30, outer cylindrical upstanding portion 32 and upper cap portion 34. The lower annular flange 30 is configured to matingly engage with the upper mating structure 23 of the upper body 20. In certain embodiments, the two structures are configured to engage with each other in a permanent engagement, wherein separation is virtually impossible without destruction of the device. In other embodiments, the two can be releasably maintained together.

The outer cylindrical upstanding portion extends upwardly from the base 12 and is generally of a uniform diameter. The upstanding portion includes helical groove 40 which extends about the outer surface. The helical groove 40 includes upper opening 42, lower opening 44, base surface 46 and sidewalls 48. The helical groove extends from a distal end to a proximal end of the upstanding portion. The base surface 46 is generally of uniform width with the sidewalls 48 providing, with the base surface, a slot for the placement of the LED assembly.

In the embodiment shown, the helical groove extends about the entirety of the upstanding portion approximately four full revolutions. Of course, the configuration and the spacing of the helical groove will vary with the type and configuration of the LED assembly relative to the upstanding portion. It will also be understood that the diameter of the upstanding portion can be varied for different applications. In the embodiment shown, the diameter generally corresponds to the diameter of the widest portion of a conventional bulb (either incandescent or cfl). Such a dimension is not required.

The upper cap portion 34 generally comprises a domed shaped configuration having a plurality of openings 35 that are positioned thereabout. The openings provide heat dissipation from the electrical drive and any residual heat that radiates inwardly from the LED assembly. Of course, the configuration of the upper cap portion is not limited to a domed convex configuration and other configurations are contemplated for use. In addition, the positioning of the openings, as well as the quantity thereof can be varied.

The LED assembly 16 is shown in FIG. 7 as comprising a strip 50 of discrete LED elements 52 that are embedded within a clear polymer matrix. The LED elements are generally of the same output and are spaced apart uniformly along the strip. The strip includes a first end 53 and a second end 55, and a conductor lead is coupled thereto, with the LED elements connected to each other in series. In other embodiments, the LED elements may be spaced apart at different intervals, and may be applied to a carrier member (i.e., without being embedded within a polymer matrix). It will be understood that by varying the LED elements, a wider or narrow strip may be provided, with the spacing of the different LED elements being varied.

The electrical drive 18 is shown in FIG. 1 as comprising voltage transformer and associated circuitry 60, first input conductor 62, second input conductor 64, first output conductor 66 and second output conductor 68. The particular electrical drive is configured to generally reduce line voltages (typically 110-220 AC at 50-60 Hz) to a DC voltage suitable for application to the LED assembly. Of course, the particular configuration of the electrical drive can be varied, as long as the proper electrical power is provided to the LED assembly. Conveniently, the electrical drive can be maintained within the cavity created by the base and/or the helical body portion.

In operation, the user merely replaces a current incandescent bulb or cfl bulb with a light bulb of the present disclosure. Once energized, each of the LED elements 52 will provide a light output generally perpendicular to the surface of the helical body portion. By applying a helical pattern to the LED strip, and the proper spacing of the LED elements 52, light will be provided outwardly at virtually every point along the outer circumference of the helical body portion. In turn, a uniform light will emanate from the light bulb assembly. Advantageously, through such a construction, dead spots, or odd light patterns can be avoided in favor of a generally uniform distribution of light emanating from the light bulb assembly.

Variations can be made in both the spacing of the LED elements, the helical winding configuration of the LED elements, the output of the LED elements and the number of LED elements so as to impart a different lighting pattern.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A light bulb assembly comprising:

a base including a cap electrically connectable to a power source;

a helical body portion having an outer cylindrical upstanding portion, the helical body portion extending from the base, with a helical groove disposed along an outer surface of the helical body portion, the helical groove defining a base surface and opposing sidewalls which are perpendicular to the base surface; and a LED assembly having a strip including a plurality of LED elements that are in a spaced apart orientation, the strip having a width substantially equal to a width of the base surface and being positionable in the helical groove of the helical body portion, so as to extend over the base surface and abutting each of the opposing sidewalls; and an electrical drive configured to supply power from the power source to the LED elements, the electrical drive being positioned within the cavity created by at least one of the base and the helical body portion.

2. The lightbulb assembly of claim 1 wherein the helical groove has a substantially rectangular cross-sectional configuration.

3. The lightbulb assembly of claim 1 wherein the LED elements are embedded within a clear polymer matrix.

4. The lightbulb assembly of claim 1 wherein the LED elements define an outermost surface above the base.

5. The lightbulb assembly of claim 1 wherein the helical groove has an upper opening at an upper end of the helical groove, and a lower opening proximate a lower end of the helical groove, the LED assembly extending out of the lower opening and along the helical groove and into the upper opening.

6. the lightbulb assembly of claim 5 wherein the helical body includes a cavity, with the upper opening and the lower opening providing access to the cavity.

* * * * *